US005657966A

United States Patent [19]

Cicinnati

[11] Patent Number: 5,657,966

[45] Date of Patent: Aug. 19, 1997

[54] METALLIC GUARDRAIL BARRIER

[75] Inventor: Luigi Cicinnati, Padua, Italy

[73] Assignee: Advanced Investment Holding S.A., Luxembourg

[21] Appl. No.: 634,250

[22] Filed: Apr. 18, 1996

[30] Foreign Application Priority Data

Apr. 27, 1995 [IT] Italy ..... BO95A0184
Apr. 27, 1995 [IT] Italy ..... BO95A0185

[51] Int. Cl.[6] ..... E01F 15/00

[52] U.S. Cl. ..... 256/13.1; 404/6; 52/98

[58] Field of Search ..... 256/13.1; 404/6; 52/98; 403/2

[56] References Cited

U.S. PATENT DOCUMENTS 3,332,666 7/1967 Gray ..... 256/13.1
3,712,589 1/1973 Peterson et al. ..... 52/98 X
4,610,432 9/1986 Lewis et al. ..... 52/98 X
4,838,523 6/1989 Humble et al. ..... 256/13.1
5,044,609 9/1991 Cicinnati et al. ..... 256/13.1
5,286,137 2/1994 Cicinnati et al. ..... 404/6

*Primary Examiner*—Anthony Knight
*Attorney, Agent, or Firm*—Larson and Taylor

[57] ABSTRACT

The metallic guardrail barrier comprises a sustaining post and a spacing member extending parallel to the ground, secured at one side to the sustaining post and carrying at the other side of the rail. The spacing member includes a window presenting a quadrilateral shape with four sides defining as many vertexes. The spacing member is made of metallic material which is plasticizable under impelling loads, and one or more holes are provided on the spacing member in proximity of the vertexes of the quadrilateral window. Upon impact by a colliding vehicle, the spacing member is deformed in a controlled manner due to the fact that the quadrilateral window tends to collapse as an articulated quadrilateral.

6 Claims, 7 Drawing Sheets

METALLIC GUARDRAIL BARRIER

The present invention relates to a metallic guardrail barrier which presents properties of controlled deformation upon impact by colliding vehicles.

In case of impact by a colliding vehicle, the metallic guardrail barriers of known type, comprising generically a rail maintained at a certain height by suitable supporting posts, are distorted in a manner which cannot be foreseen and the rail is often bent transversely with outward rotation of its upper portion, thus forming an inclined surface that can be easily passed over by the vehicle that has struck the barrier.

According to U.S. Pat. Nos. 5,044,609 and 5,286,137 there has been proposed a type of guardrail barrier comprising a plurality of sustaining posts which sustain the rail. Each sustaining post presents at a certain height a spacing member extending parallel to the ground. The rail is carried at one side by the spacing member, which is connected at the opposite side-to the sustaining post. The spacing member is connected with the sustaining post and with the rail by means of shock absorbing systems in the form of weakened portions which are ruptured or bent, upon impact by a colliding vehicle, according to a predetermined pattern so that the rail is maintained substantially in its vertical condition and is raised with respect to its original position. In addition to the shock absorbing systems connecting the spacing member with the rail and with the sustaining post, the spacing member presents a quadrilateral window including top and bottom sides parallel to the ground and oblique sides, the whole being shaped in such a manner so as to collapse in an upwardly manner in response to a particularly energetic impact of the colliding vehicle. The deformation of the spacing member at the zone of the quadrilateral window, however, takes place in a manner which is not always predictable and in any case does not follow the desired purpose which would be that of reproducing the collapse of an articulated quadrilateral, represented by the window.

According to the present invention, it has been found that a beam like element made-of metallic material which is plasticizable under impelling loads and which presents a substantial flat surface can be subjected to a controlled deformation following to such impelling loads in the following manner: on its flat surface there is provided at least one polygonal window defining vertexes and at least one hole is provided in proximity of each vertex of the said polygonal window. In such a manner, each vertex defines a plastic hinge which leads to a controlled deformation, under an impelling load, of the window, and consequently to a controlled deformation of the metallic beam. In the case of a polygonal window shaped like a quadrilateral window, the deformation of the window will tend to be ideally close to the deformation of an articulated quadrilateral, and consequently the deformation of the beam will take place according to a broken line.

The provision of a quadrangular window of the above type in correspondence of the flat surface of the spacing member which carries the rail and, if required, also in the flat surface of the sustaining post carrying the spacing member, will lead to a controlled deformation in a desired manner of the structure which carries the guardrail, upon impact by a colliding vehicle- This deformation is calculated in such a manner that upon crash of the colliding vehicle, there takes place a dissipation of collision energy and the rail is considerably raised in a safe and predictable manner thus performing a self-adaptation for holding the vehicle which, as above said, has the tendency of jumping over the rail.

The above and other features of the invention will appear evident from the following detailed description of a preferred embodiment, made with reference to the figures of the attached drawings in which.

Figure 1:
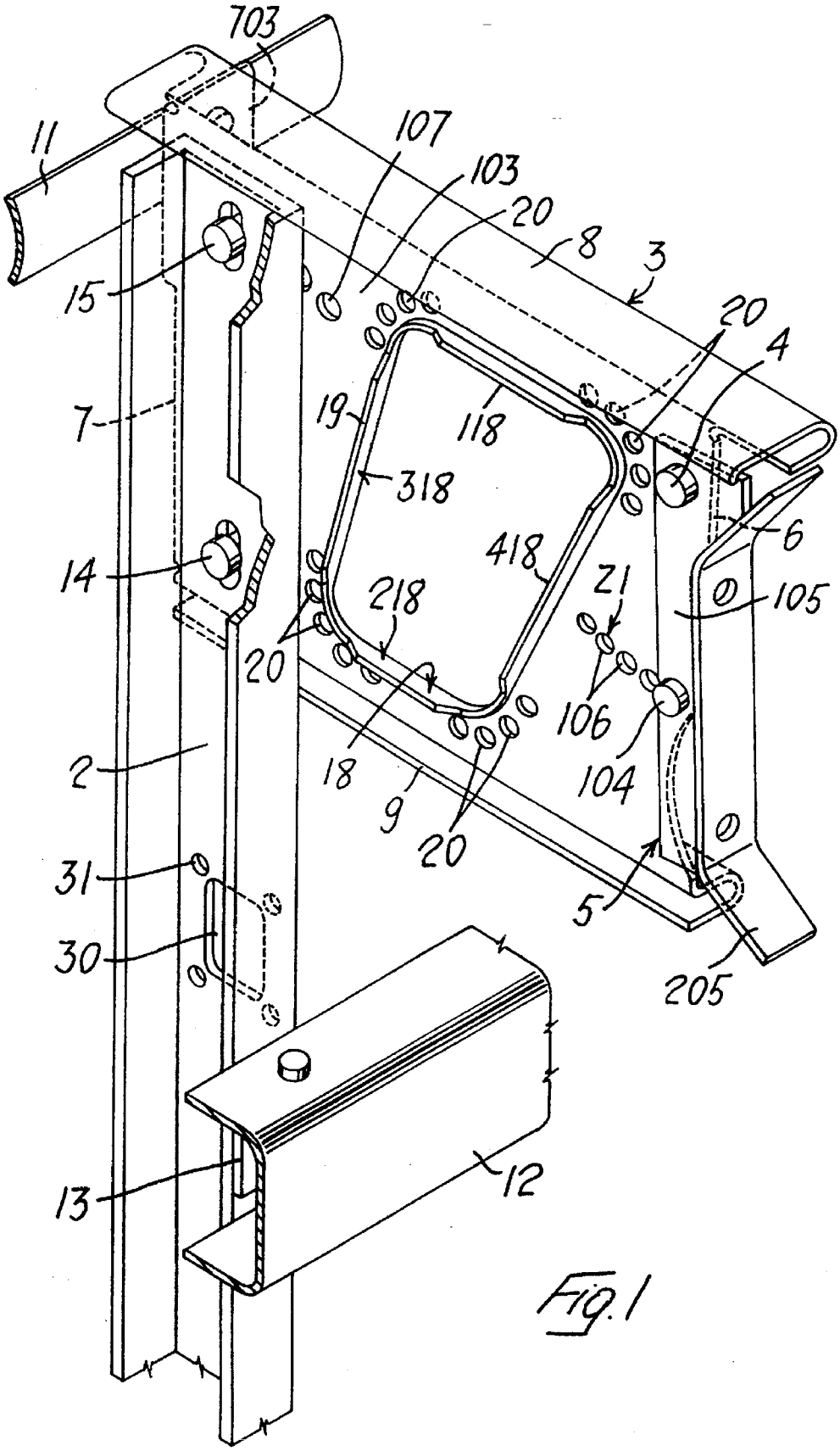
FIG. 1 is a perspective view of a rail sustaining unit comprising a sustaining post and a spacing device for supporting the rail.
Figure 2:
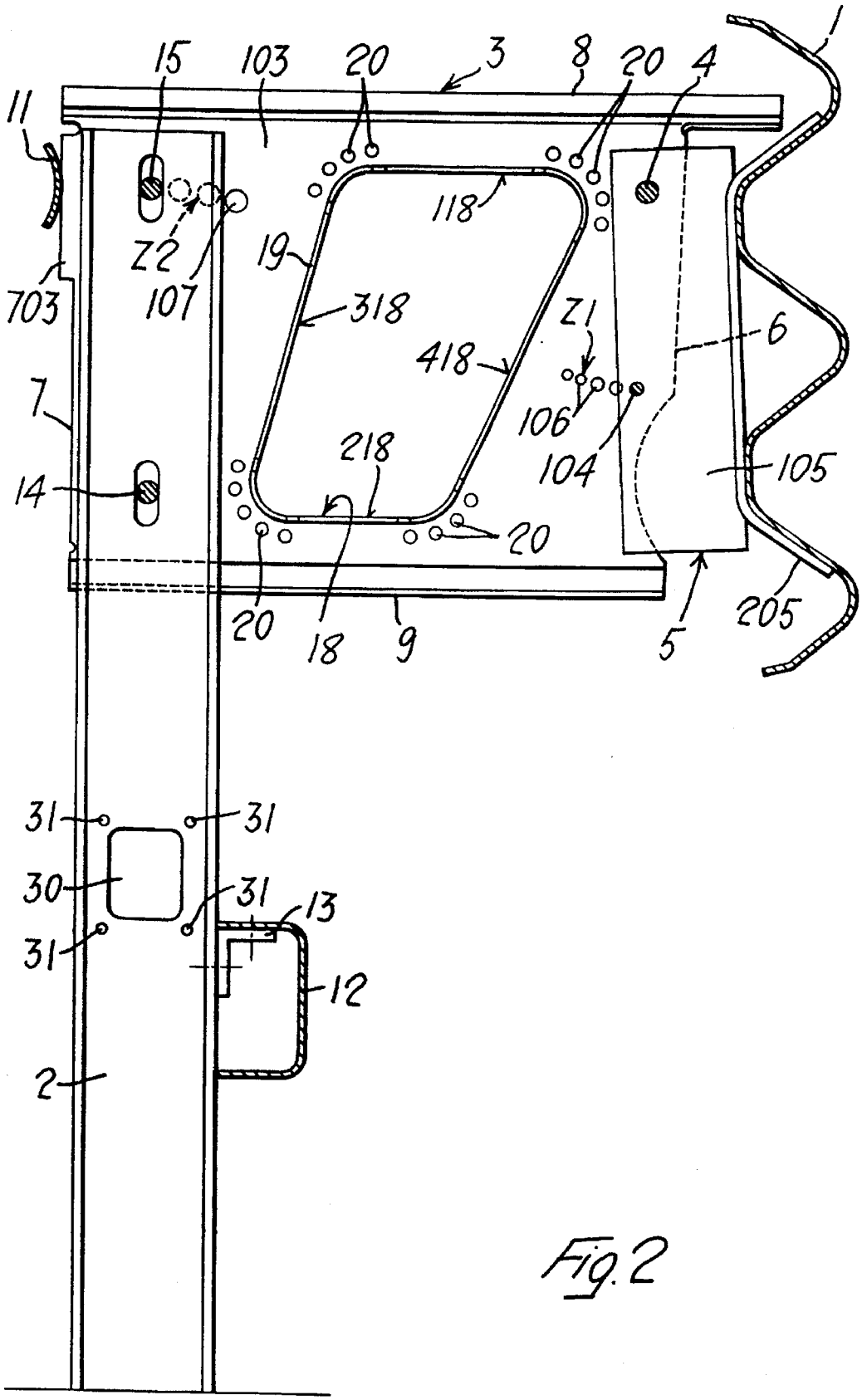
FIG. 2 is a side elevational view of the rail sustaining unit according to FIG. 1.

With reference to the Figures, the guardrail barrier comprises a steel ribbon or rail i of the road barrier, which may also have a different profile. The reference numeral 2 indicates one of the vertical posts projecting from the ground which sustain the rail 1 in place and the reference numeral 3 indicates a spacing member secured in cantilever fashion to the top portion of the post 2 and supporting the rail 1 at the opposite end thereof. The spacing element 3 is made of metal sheet plasticizable under impelling loads. Each spacing member 3 presents a substantially rectangular shape and is limited by a front side 6 and a rear side 7 substantially vertical and by an upper side 8 and a lower side 9, substantially horizontal. The upper and lower sides 8 and 9 are C-shaped so as to constitute stiffening ribs. The rear side 7 is provided in the upper portion thereof with an integral squarely-bent wing 703 to which a C-shaped beam 11 may be secured. The beam 11 is arranged on the outer rear sine of the sustaining post 3 and connects all the spacing members 5 of the various supporting devices (i.e. sustaining posts and spacing members) for the guardrail, so as to distribute to the adjoining devices the stresses imposed to each device by a vehicle colliding against the guardrail 1. For the same reason, and also to avoid any dangerous interference of the forecarriage of a colliding vehicle with the sustaining posts 2, the said sustaining posts are interconnected, at a suitable height above the ground, by means of a beam 12 secured in place by brackets 13.

Figure 5:
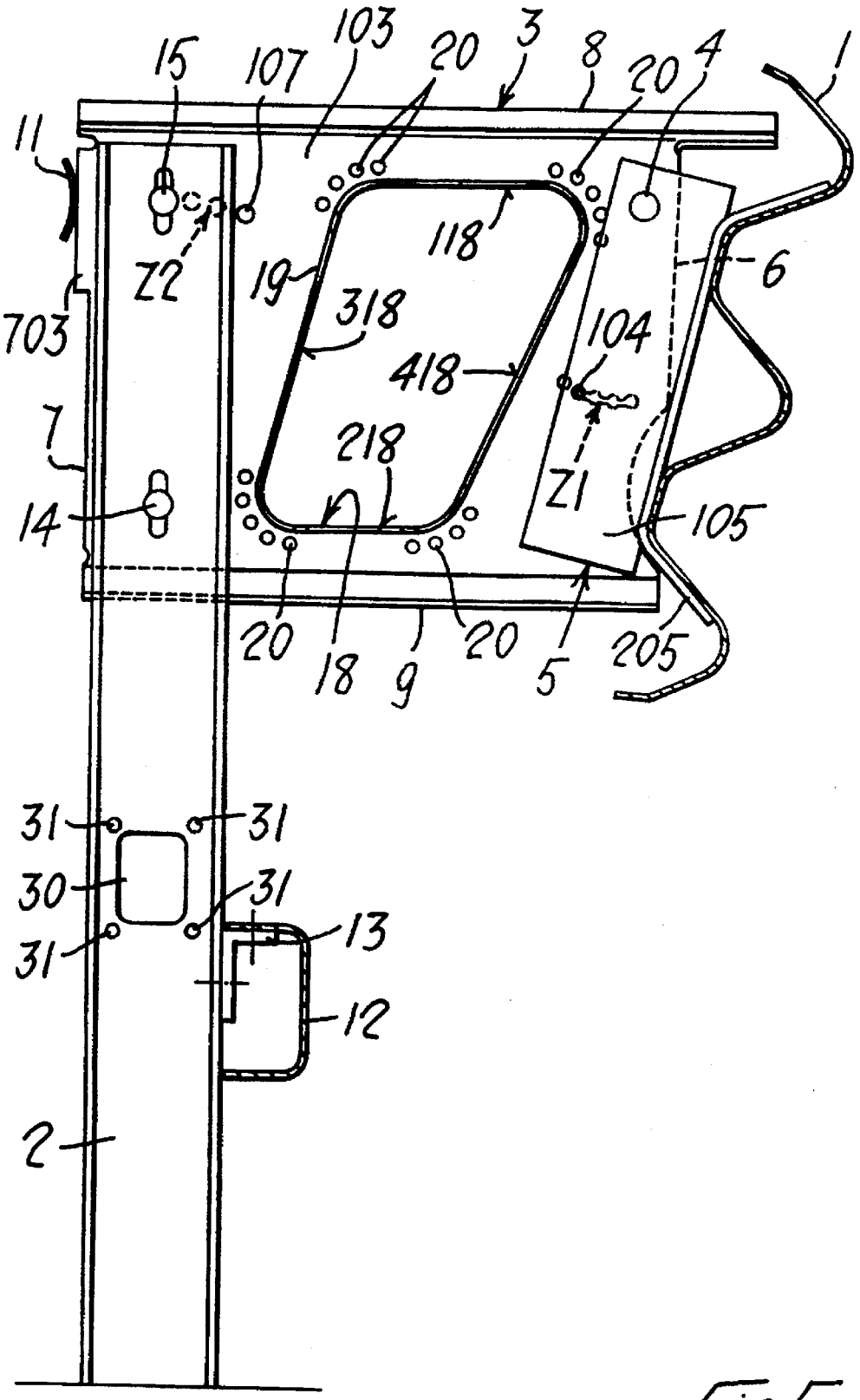
FIGS. 5, 6, 7 and 8 are side elevational views of the rail sustaining unit of FIGS. 1 and 2 in some significant steps of the controlled deformation sequence to which the sustaining unit may be submitted.

The rail 1 is supported at its rear side by the suitably shaped wing portion 205 of a square angle support 5 which by the other flat wing 105 thereof is connected to the spacing member 3 by means of a shock absorbing system Z1 in which the top portion of the wing 105 is pivoted to the spacing member 3 by means of a pin 4 whereby the support 5 may be swung about an axis which is parallel to the longitudinal axis of the rail 1. The lower portion of the wing 105 is secured to the member 3 by means of another pin 104 which, in case of a crash of a motor vehicle against the rail 1, is caused to be swung in outward direction (i.e. in a direction exterior to the road), as shown in FIG. 5 thus tearing a corresponding area of the member 3 which has been weakened by holes 106.

Figure 6:
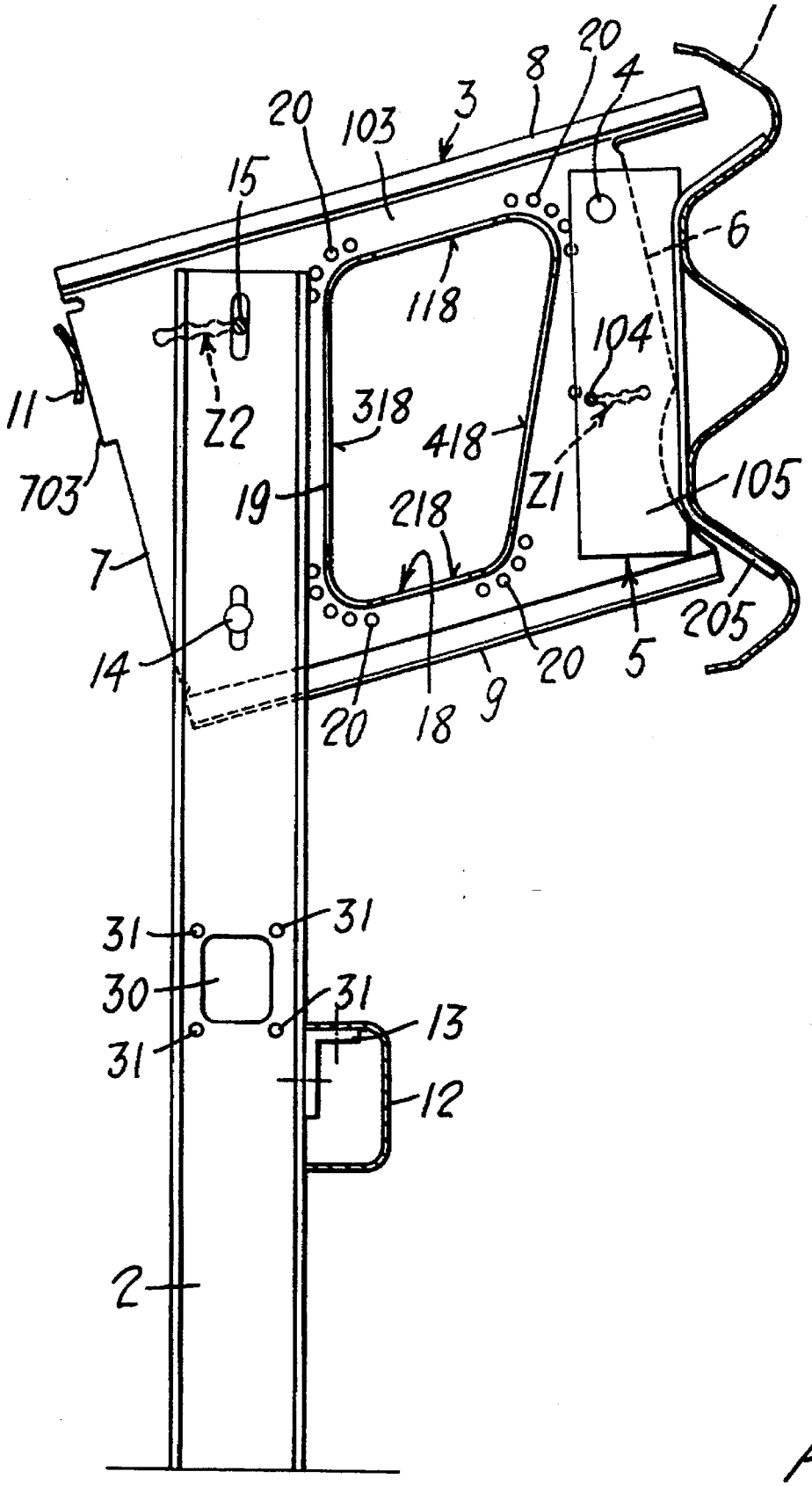

The body 103 of the spacing member 3 is connected to the sustaining post 2 through a shock absorbing system Z2 similar to the system Z1 above described, but the said system Z2 is turned upside down so that in case of crash the spacing member will be oscillated upwards. More particularly, the lower rear portion of the member 3 is pivoted to the sustaining post 2 by means of a pin 14 which is parallel to the pin 4, while the upper rear portion thereof is secured to the post by means of a further pin 15. In case of crash of a colliding vehicle, the pin 15 will tear an area of the member 3 weakened by holes 107 (see FIG. 6). The design characteristics of the shock-absorbing system Z2 may be such to let it become operative either after or before the system Z1, or simultaneously therewith.

With particular reference to FIGS. 1 to 4 it is to be noted that the spacing member 3, approximately at its intermediate region, is provided with a polygonal window 18, framed by a stiffening rim 19. In the embodiments as shown, the window 18 is quadrilateral with two sides 118, 218 parallel and horizontal and two sides 318, 418 inclined of an acute angle with respect to the respective sustaining post 2 so as to define between them an acute angle, the ideal vertex of which is located below the spacing member 3.

At each vertex of the polygonal window 18 there is provided at least one hole 20 so as define and localize a zone of plasticization which causes the spacing member to be deformed in a predetermined manner according to a broken-line design which tends to a "Z" design instead than a "S" design as it happens in the case of spacing members presenting windows without the said vertex holes 20 such as for example illustrated in U.S. Pat. No. 5,044,609.

Figure 3:
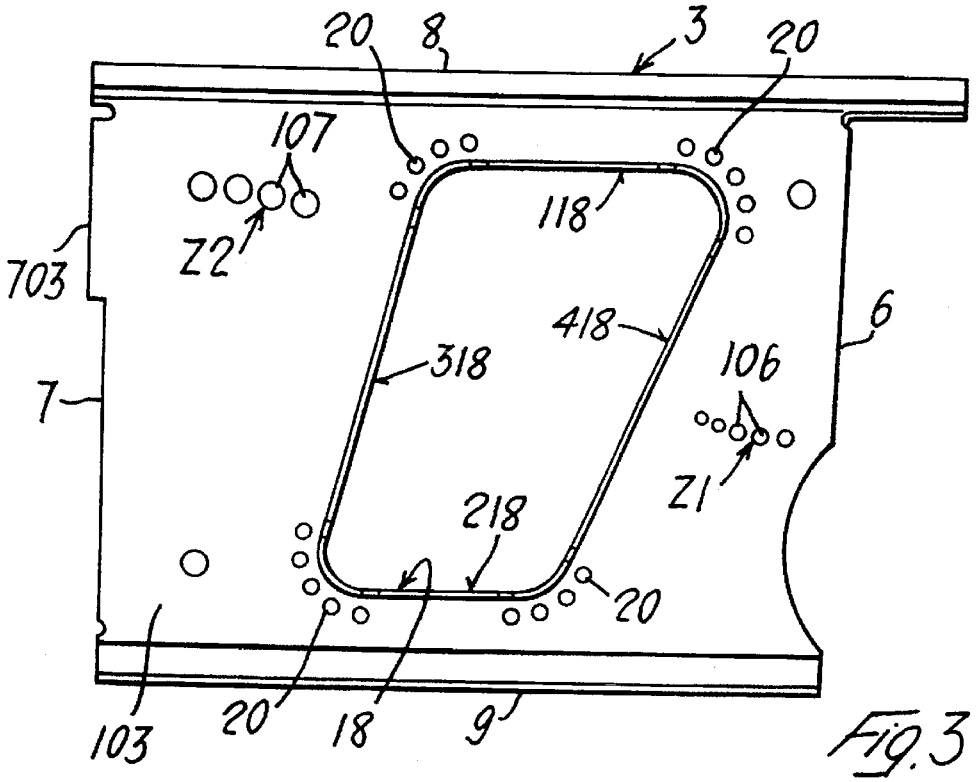
FIG. 3 is a side elevational view illustrating in detail the spacing member employed in the sustaining unit according to FIGS. 1 and 2.

As illustrated in FIG. 3 the vertexes of the window 18 are rounded, and a plurality of holes 20 are distributed along a rounded path at each vertex.

Figure 4:
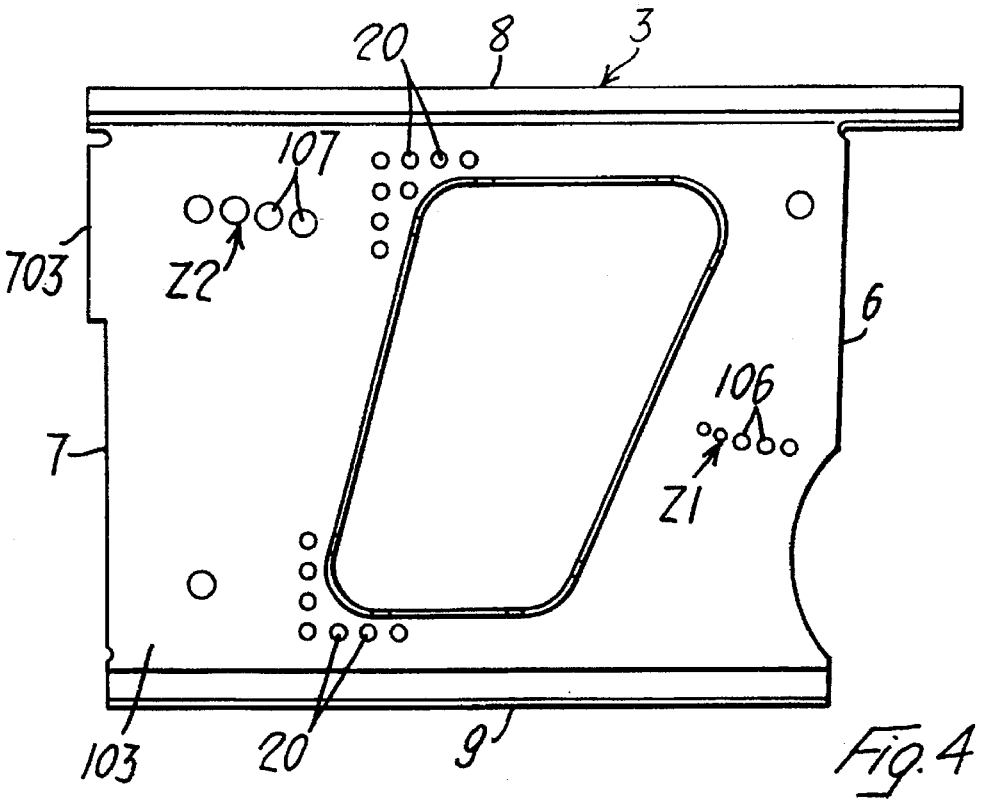
FIG. 4 is a side elevational view of a modified version of the spacing member employed in the sustaining unit.

According to a modified embodiment shown in FIG. 4, the plasticizing holes 20 are provided just in correspondence of two contiguous vertexes of the window 18, preferably the two vertexes connected by the inclined side 318 nearer to the sustaining post 2. In this case the holes are arranged according to a rectangular pattern, and may be arranged in more than one row for each vertex.

Figure 7:
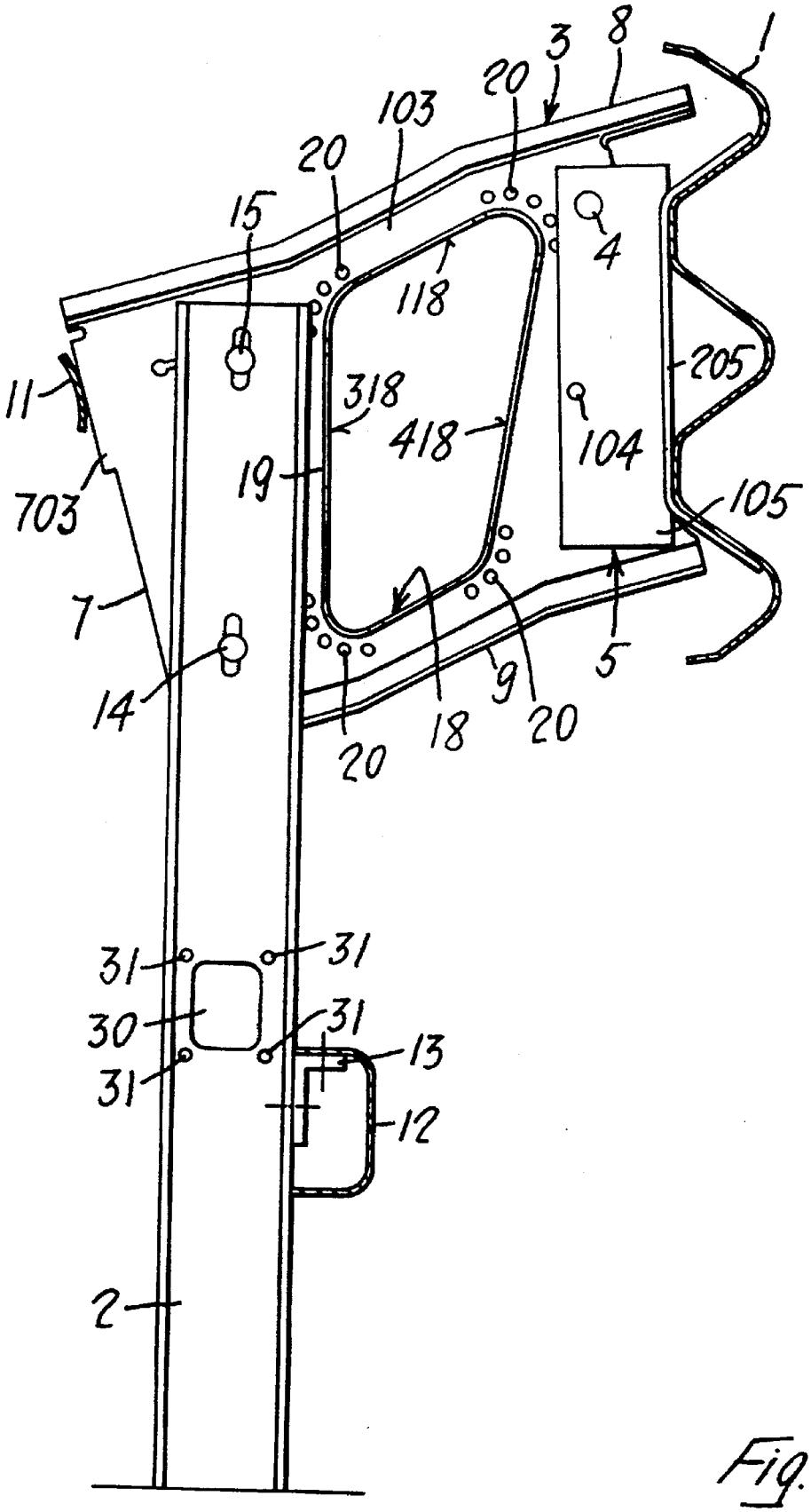
Figure 8:
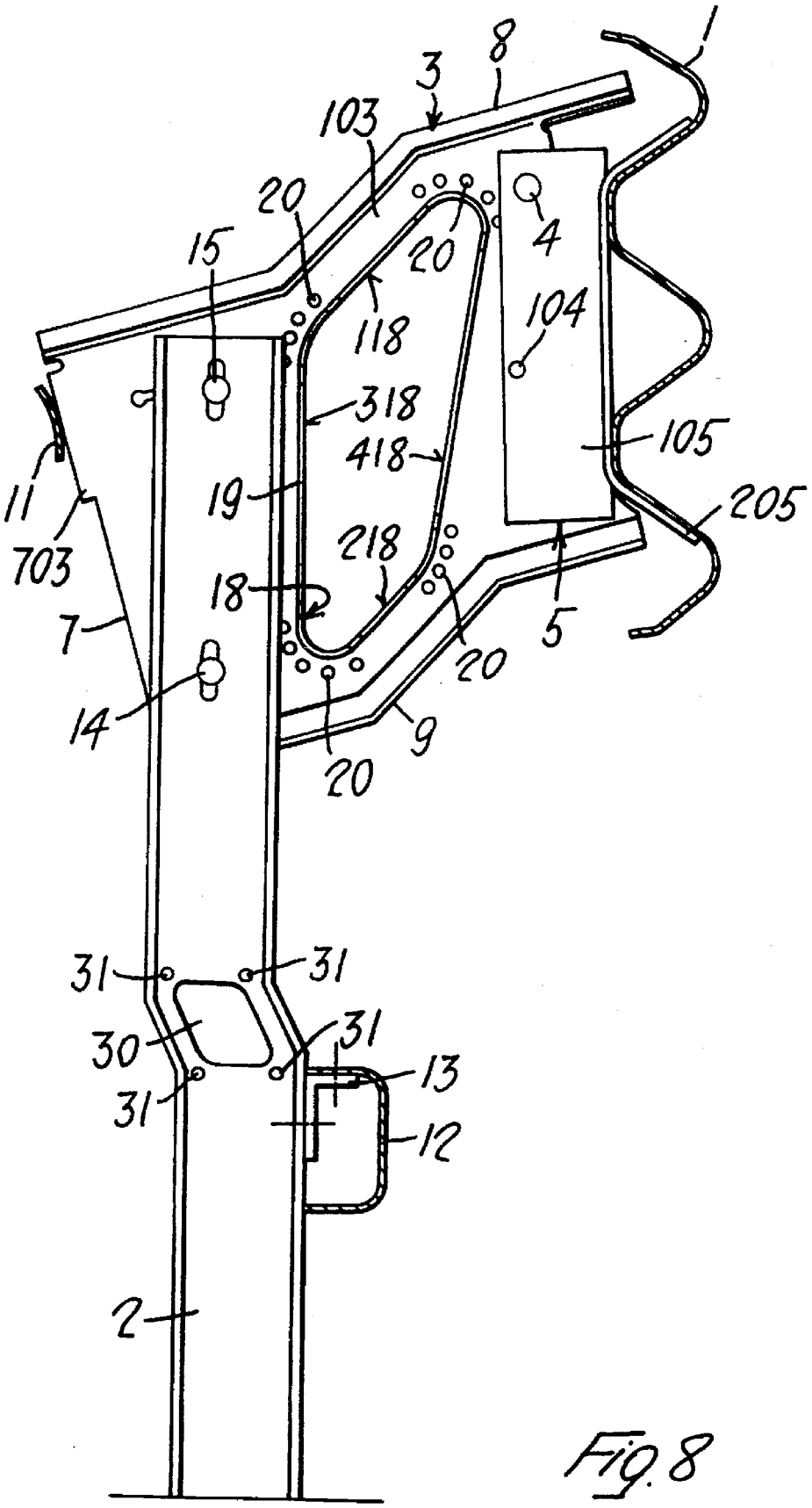

In case of a crash which leads to the deformation of the quadrilateral window 18, the deformation of the window will tend to be ideally close to the deformation of an articulated quadrilateral, as indicated in FIGS. 7 and 8.

Each sustaining post 2 presents, at a position comprised between the spacing member 3 and the beam 12, a second window 30 of substantially rectangular shape and having at each vertex a hole 31 so as to localize another plasticization zone in correspondence of the said sustaining post, so that in case of a particularly strong crash, also the sustaining post is bent outwards according to a broken line about a bending zone located in the region of the said second window 30, as indicated in FIG. 8.

I claim:

1. A metallic guardrail barrier of the type comprising a sustaining post, a spacing member extending parallel to the ground, secured at one side to the sustaining post and carrying at the other side the rail, the spacing member including at least one first window therein formed presenting a polygonal shape with sides defining vertexes, characterized by the fact that the spacing member is made of metallic material which is plasticizable under impelling loads, and at least one hole is provided on the spacing member in proximity of each one of at least two contiguous vertexes of the polygonal first window.

2. A guardrail barrier according to claim 1, characterized by the fact that the first window is quadrilateral with two sides which are parallel and substantially horizontal and two other sides inclined.

3. A guardrail barrier according to claim 2, characterized by the fact that the vertexes of the first window are rounded.

4. A guardrail barrier according to claim 3, characterized by the fact that a plurality of holes are provided in the spacing member along a rounded path at each vertex.

5. A guardrail barrier according to claim 2, characterized by the fact that a plurality of holes are provided in the spacing member according to a rectangular path in correspondence of each one of at least the two contiguous vertexes of the inclined side nearer to the sustaining post.

6. A guardrail barrier according to claim 1, characterized by the fact that the sustaining post includes at least one second window therein formed presenting a polygonal shape with sides defining vertexes and at least one hole in proximity of each vertex of the polygonal second window.

* * * * *